US008573733B2

(12) United States Patent
Mandel et al.

(10) Patent No.: US 8,573,733 B2
(45) Date of Patent: Nov. 5, 2013

(54) PROTECTIVE DEVICE FOR INKJET PRINTHEADS

(75) Inventors: Barry Paul Mandel, Fairport, NY (US); Jeffrey J. Folkins, Rochester, NY (US); Joannes N. M. DeJong, Hopewell Junction, NY (US); Lloyd A. Williams, Mahopac, NY (US); Linn C. Hoover, Webster, NY (US); Ruddy Castillo, Briarwood, NY (US)

(73) Assignee: Xerox Corporation, Norwalk, CT (US)

( * ) Notice: Subject to any disclaimer, the term of this patent is extended or adjusted under 35 U.S.C. 154(b) by 268 days.

(21) Appl. No.: 12/777,979

(22) Filed: May 11, 2010

(65) Prior Publication Data

US 2011/0279613 A1 Nov. 17, 2011

(51) Int. Cl.
*B41J 2/165* (2006.01)

(52) U.S. Cl.
USPC ..... 347/29; 347/8; 347/104

(58) Field of Classification Search
USPC ..... 347/8, 20, 22, 29, 40, 47, 104
See application file for complete search history.

(56) References Cited

U.S. PATENT DOCUMENTS

| | | | | |
|---|---|---|---|---|
| 5,570,123 | A | 10/1996 | Almonte | |
| 5,735,616 | A | 4/1998 | Sugiura | |
| 6,347,859 | B1 * | 2/2002 | Kawakami et al. | 347/40 |
| 6,604,813 | B2 | 8/2003 | Green | |
| 7,648,228 | B2 | 1/2010 | Kojima | |
| 2002/0134305 | A1 * | 9/2002 | Miki et al. | 118/300 |
| 2005/0134647 | A1 | 6/2005 | Silverbrook | |
| 2008/0165224 | A1 * | 7/2008 | Akahane | 347/50 |
| 2010/0079542 | A1 * | 4/2010 | Ciminelli et al. | 347/40 |
| 2010/0290065 | A1 * | 11/2010 | Shestak | 358/1.9 |

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

An inkjet printhead is configured to reduce the likelihood of media coming into contact with a printhead face. The inkjet printhead includes a housing, an aperture plate having a plurality of apertures in an aperture area through which inkjet ejectors eject ink, and a pair of members aligned with a direction of media movement and extending along a length of the aperture area, the pair of members being configured to lift media away from the plurality of apertures in the aperture area.

12 Claims, 9 Drawing Sheets

PROTECTIVE DEVICE FOR INKJET PRINTHEADS

TECHNICAL FIELD

The process and device described below relate to imaging devices and, more particularly, to inkjet printheads in inkjet imaging devices.

BACKGROUND

Drop on demand inkjet technology for producing printed images has been employed in products such as printers, multifunction products, plotters, and facsimile machines. Generally, an inkjet image is formed by selectively ejecting ink drops from a plurality of drop generators or inkjets, which are arranged in a printhead, onto an image receiving substrate. For example, the image receiving substrate may be moved relative to the printhead and the inkjets may be controlled to emit ink drops through nozzles formed in the printhead at appropriate times. The timing of the inkjet activation is performed by a printhead controller, which generates firing signals that activate the inkjets to eject ink. The ink ejected from the inkjets is liquid ink, such as aqueous, solvent, oil based, curable ink, or the like, which is stored in containers installed in the printer. Alternatively, the ink may be loaded in a solid or a gel form and delivered to a melting device, which heats the ink to generate liquid ink that is supplied to a printhead.

The ejected ink travels through an air gap between the printhead face and the image receiving substrate. The greater the distance between the printhead face and the image receiving member, the greater the expelled ink drop speed and consistency required to travel this distance and land on the substrate at the position intended for the ejected ink drops.

Inkjet printers that print images on precut sheets of print media are referred to as cut sheet inkjet printers. Cut sheet inkjet printers strip media sheets from a supply of media sheets stacked on an input tray. A media conveyer transports each stripped media sheet through a print zone of the printer. The inkjets eject ink onto the print media as the media conveyer transports the print media through the print zone. After receiving ink from the inkjets, the media conveyer transports the stripped media sheet to an output tray. Once received by the output tray the media sheets are collected by a user or received by another printing system for further processing.

The media conveyer transports the media sheets through the print zone where the printheads are operated to eject ink onto a surface of the media sheets. Accordingly, an air gap is required that is large enough to enable sheets of different thicknesses to pass by the printheads. If the airgap is too large the resultant image quality will suffer because of poor placement of the ink drops on the sheet medium. These competing restrictions on the air gap between the printheads and the media sheets can be balanced provided the media sheets stripped from the input tray are flat and free from creases or other imperfections. Some media sheets stripped from the input tray, however, may include creases and other imperfections. As the media conveyer transports these media sheets, the imperfect portions of the media sheet may pass through the print zone at a distance too close to the printheads for accurate placement of the ink drops. Additionally if the media sheet were to actually touch the printhead at any point there is significant danger of disrupting the complete functioning of one or more of the jets. This disruption might be either temporary or permanent but in either case the image quality will suffer significantly. Consequently, image quality may be affected by the close passage of the media sheets to the printhead. For example, some nozzles in the printhead may become clogged by particulate matter carried by a media sheet and image streaks and/or missing pixels may be produced in the printed image. Therefore, control of the distance between media surfaces and the printhead faces in the print zone is useful.

SUMMARY

An inkjet printhead is configured to reduce the likelihood of media coming into contact with a printhead face. The inkjet printhead includes a housing, an aperture plate having a plurality of apertures in an aperture area through which inkjet ejectors eject ink, and a pair of members aligned with a direction of media movement and extending along a length of the aperture area, the pair of members being configured to lift media away from the plurality of apertures in the aperture area.

The inkjet printheads configured to reduce contact between media and a printhead face may be incorporated in an inkjet printhead array. The inkjet printhead array includes a plurality of printheads arranged to eject ink in a continuous line across media passing by the plurality of printheads, each printhead having an aperture plate having a plurality of apertures through which inkjet ejectors eject ink, and a pair of members positioned proximate the plurality of printheads and aligned with a direction of media movement past the plurality of printheads, the pair of members being configured to lift media away from the plurality of apertures in the aperture plates of the plurality of printheads.

An alternative embodiment of an inkjet printhead array is configured to reduce contact between media and the printheads in the array without requiring each printhead to be configured with a nozzle protector. The inkjet printhead array includes a plurality of printheads arranged to eject ink in a continuous line across media passing by the plurality of printheads, each printhead in the plurality of printheads including a housing, an aperture plate having a plurality of apertures in an aperture area through which inkjet ejectors eject ink, and a pair of members aligned with a direction of media movement and extending along a length of the aperture area, the pair of members being configured to lift media away from the plurality of apertures in the aperture area.

BRIEF DESCRIPTION OF THE FIGURES

The foregoing aspects and other features of the present disclosure are explained in the following description, taken in connection with the accompanying drawings.

DETAILED DESCRIPTION

The apparatus and method described herein make reference to printheads and printhead arrays adapted for use in a printing system. The term "print medium" refers to any article with a surface suited to having ink printed onto it, with paper being a common example. A "printhead" as used herein refers to a device that ejects a fluid, such as ink, onto a print medium. Each printhead has an aperture plate with a plurality of apertures, also known as nozzles, etched into the aperture plate's surface. These nozzles eject ink droplets onto the print medium. A "printhead array" as used herein refers to an assembly of at least two printheads positioned relative to one another to print over an area of a print medium. For example, in a common type of print array, two or more printheads are placed in staggered positions so that the entire printable surface of a print medium may be covered in ink.

Figure 1A:
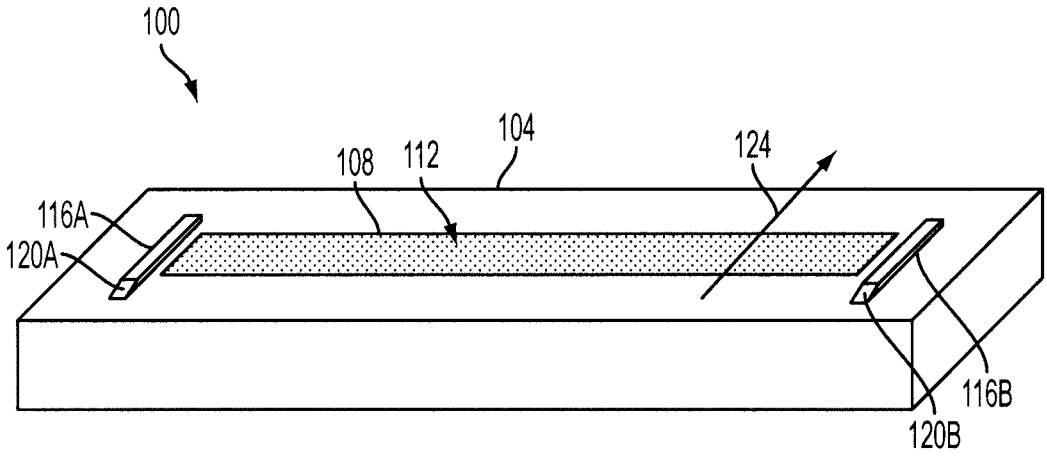
FIG. 1A is a perspective view of an inkjet printhead, as disclosed herein, the printhead having a nozzle protector configured to prevent contact between nozzles in the printhead and print media.

A printhead 100 with a nozzle protector is depicted in FIG. 1A. The printhead 100 has an outer housing 104 that surrounds an exposed aperture plate 108. The aperture plate 108 has a plurality of nozzles 112 formed through its surface. Each of the nozzles 112 is configured to eject ink droplets away from the surface of the aperture plate 108. A nozzle protector has two members 116A and 116B disposed on the housing. In the embodiment of FIG. 1A, the nozzle protector members 116A and 116B are a pair of raised members that are placed on either side of the aperture plate 108. Each nozzle protector member 116A and 116B extends beyond the length of the area of aperture plate 108 containing nozzles, where the length of the aperture plate is defined as the dimension of the aperture plate 108 that is aligned to the direction of movement of a print medium over the printhead 100, indicated by arrow 124. The nozzle protector members 116A and 116B are also aligned to the direction of travel of a print medium traveling over the printhead 100. In the example embodiment of FIG. 1, the nozzle protector members 116A and 116B each have a ramp, 120A and 120B, respectively. The ramps 120A and 120B are placed in the print media path such that the leading-edge of a print medium traveling in direction 124 engages the ramps 120A and 120B before the print medium begins to travel over the exposed aperture plate 108. The ramps 120A and 120B allow a print medium to engage the nozzle protector members in a smooth manner, lifting the print medium away from the aperture plate 108, and mitigating potential paper jams. While FIG. 1A shows nozzle protector members 116A and 116B placed beside aperture plate 108, the nozzle protector members may be incorporated into the aperture plate in alternative embodiments. These nozzle protector members extend along the length of areas in the aperture plate that contain nozzles. Many aperture plate designs have dimensions that are greater than the length and width of the area where nozzles are formed in the aperture plate. In these designs, the nozzle protector members may be positioned to extend beyond the length of the area bearing nozzles, but are not required to extend along the entire length of the aperture plate.

Figure 1B:
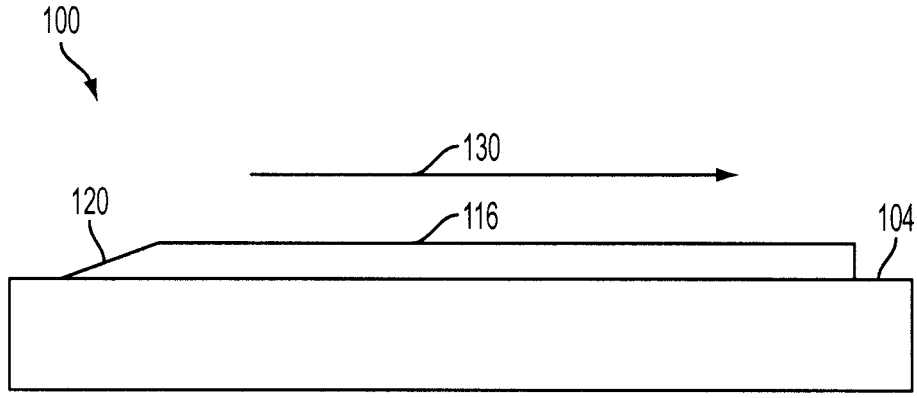
FIG. 1B is a side view of the inkjet printhead of FIG. 1A.

A side view of the printhead 100 and nozzle protector member 116 is depicted in FIG. 1B. This view shows the nozzle protector member 116, including the ramp 120 that is aligned with the direction of media travel indicated by arrow 130. The nozzle protector member 116 slopes away from the surface of housing 104 to a predetermined distance at the top of the ramp 120. In the embodiment of FIG. 1B, the nozzle protector member 116 rises a predetermined distance of 0.5 mm, but alternative embodiments may use different heights to maintain a desired distance between the printhead and print media. The nozzle protector member 116 may be formed as an extension of the printhead housing 104, such as by forming the printhead housing from a polymer and extruding the nozzle protector member 116 from the housing's surface. Alternatively, the nozzle protector member may be formed separately and attached to the surface of the housing via an adhesive layer between the bottom of the nozzle protector member and the housing. Still other embodiments may weld the nozzle protector member and housing together, or use mechanical means including screws or bolts. In embodiments using mechanical connections such as screws, the nozzle protector member may be removed by unscrewing the nozzle protector member and removing it from the housing. In still other embodiments, the nozzle protectors may be separate members positioned at either end of the printhead.

Figure 2:
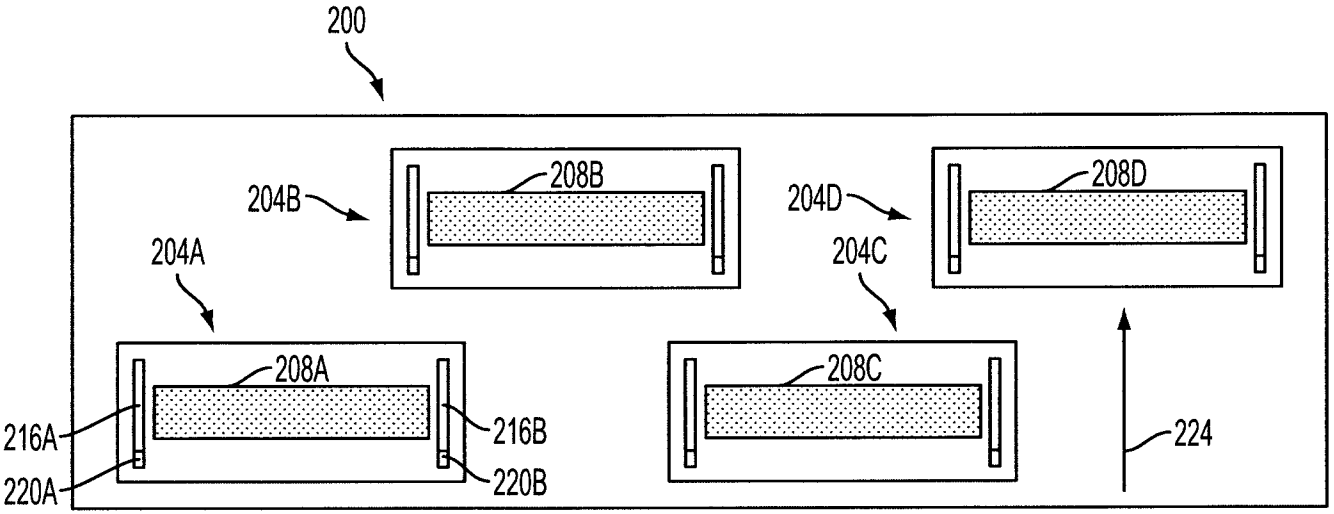
FIG. 2 is a frontal view of an inkjet printhead array that may include a plurality of inkjet printheads such as those depicted in FIG. 1A and FIG. 1B.

A frontal view of a printhead array 200 having printheads with nozzle protectors is depicted in FIG. 2. The printhead array 200 holds a plurality of printheads 204A-204D. Multiple copies of the printhead 100 shown in FIGS. 1A and 1B may be used in the example embodiment of FIG. 2. The printheads 204A-204D in printhead array 200 are staggered such that there is a degree of overlap between adjacent aperture plates 208A-208D. For example, aperture plate 208A is overlapped by aperture plate 208B along the direction of print media travel indicated by arrow 224. The staggered arrangement allows for printheads 204A-204D to eject ink droplets in a continuous line onto a print medium passing over the printhead array 200 without leaving gaps in ink coverage on the print medium. While FIG. 2 depicts a total of four printheads 204A-204D, alternative printheads may use fewer or greater numbers of printheads in the array. Additionally, while the printhead array 200 of FIG. 2 has printheads arranged in two rows, alternative staggering arrangements using three or more rows are also envisioned.

In the embodiment of FIG. 2, each of the printheads 204A-204D contains nozzle protector members exemplified by nozzle protector members 216A and 216B. As in FIG. 1A and FIG. 1B, these members are disposed along length of the aperture plate 208A, extending beyond the area of aperture plate 208A containing nozzles, and are aligned with the direction of media travel indicated by arrow 224. Each of the nozzle protector members 216A and 216B has a ramp 220A and 220B, respectively. Alternative embodiments of the nozzle protector members seen in FIG. 2 may have different widths to aid the movement of a print medium over the printhead array. In one alternative embodiment, nozzle protector member 216B could have an extended width with one end attached to printhead 204A, and the other end attached to 204C. This configuration allows a wider nozzle protector member to engage a print medium across the entire gap between printheads.

Figure 3A:
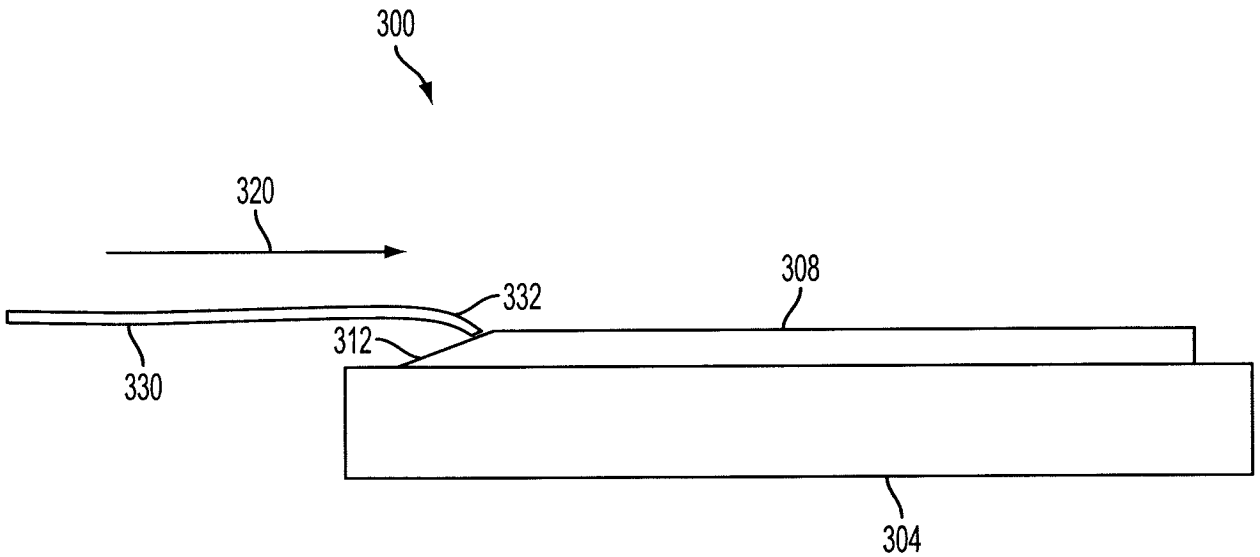
FIG. 3A is a side view of the ink jet printhead of FIG. 1A with the nozzle protector engaging a leading edge of a media sheet.

A side view of a printhead 300 with a nozzle protector member being engaged by a print medium with a curled leading edge is depicted in FIG. 3A. The print medium 330 in FIG. 3A has a curled leading edge 332. As the print medium travels in direction 320, the curled leading edge 332 engages the nozzle protector member 308, beginning with the ramp 312. The ramp 312 allows the print medium 330 to engage the nozzle protection member 308 gradually, preventing the paper from deforming which could lead to jams or reduced print quality. The print medium 330 travels along the nozzle protection member 308 which blocks the print medium 330 from contacting the surface of the housing 304, and the aperture plate with print nozzles (not shown).

Figure 3B:
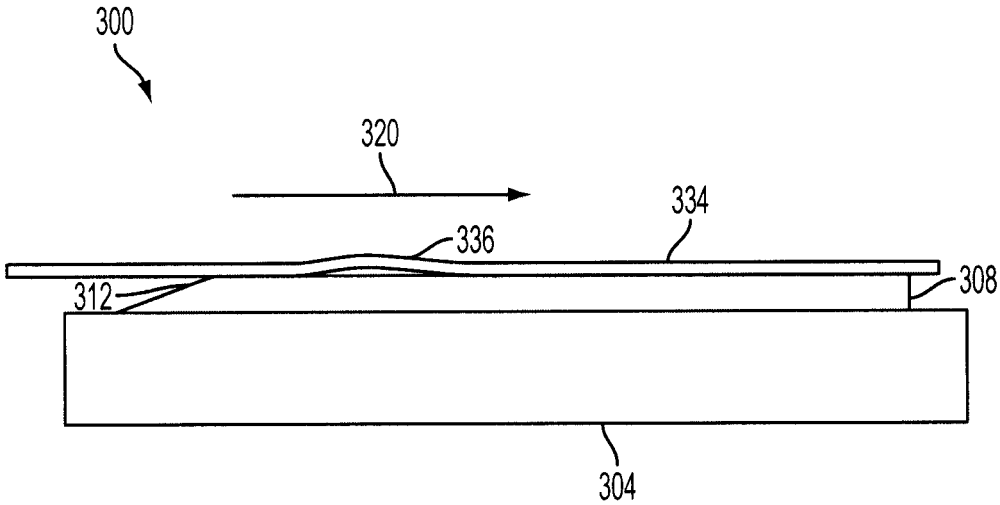
FIG. 3B is a side view of the ink jet printhead of FIG. 1A with the nozzle protector engaging central portion of a media sheet.

A side view of the printhead 300 from FIG. 3A being engaged by a print medium with a distorted central portion is depicted in FIG. 3B. In this example, a print medium 334 has a distortion 336. The print medium is engaged with the nozzle protection member 308 which prevents the distortion 336 from extending the print medium 334 into contact with the housing 304, which also contains the aperture plate with print nozzles (not shown). The example depicted in FIG. 3B shows the nozzle protection member 308 engaging the print medium 334 along the entire length of nozzle protection member 308, blocking the print medium 334 from contacting the apertures in the aperture plate.

Figure 3C:
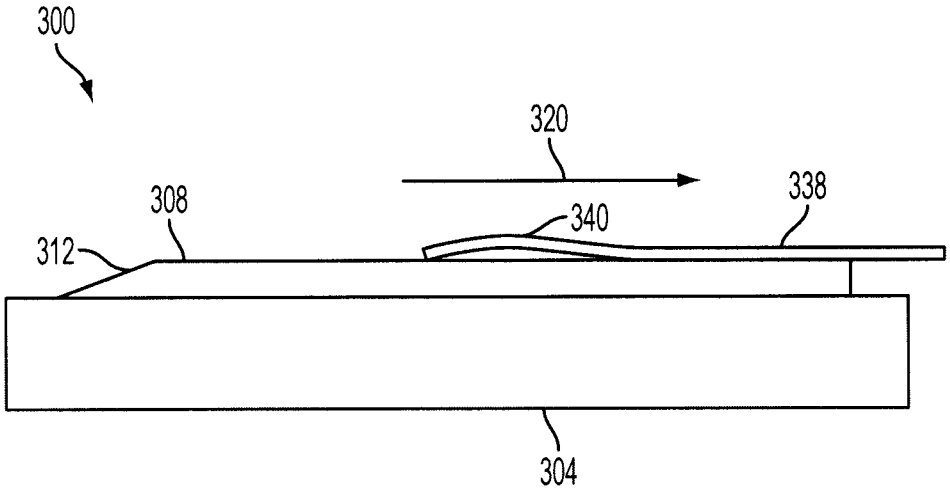
FIG. 3C is a side view of the ink jet printhead of FIG. 1A with the nozzle protector engaging a trailing edge of a media sheet.

A third view of the printhead 300 being engaged by a print medium with a curled trailing edge is depicted in FIG. 3C. In this example, the print medium 338 has a curled trailing edge 340. The curled trailing edge engages with the nozzle protection member 308 instead of curling down to contact the housing 304. The contact with the nozzle protection member 308 lifts the print medium 338 away from the surface of the housing 304, and aperture plate (not shown). As the print medium travels in the direction indicated by arrow 320, the curled edge 340 remains in contact with the nozzle protection member 308, and is blocked from contact with the aperture plate and nozzles.

Figure 4A:
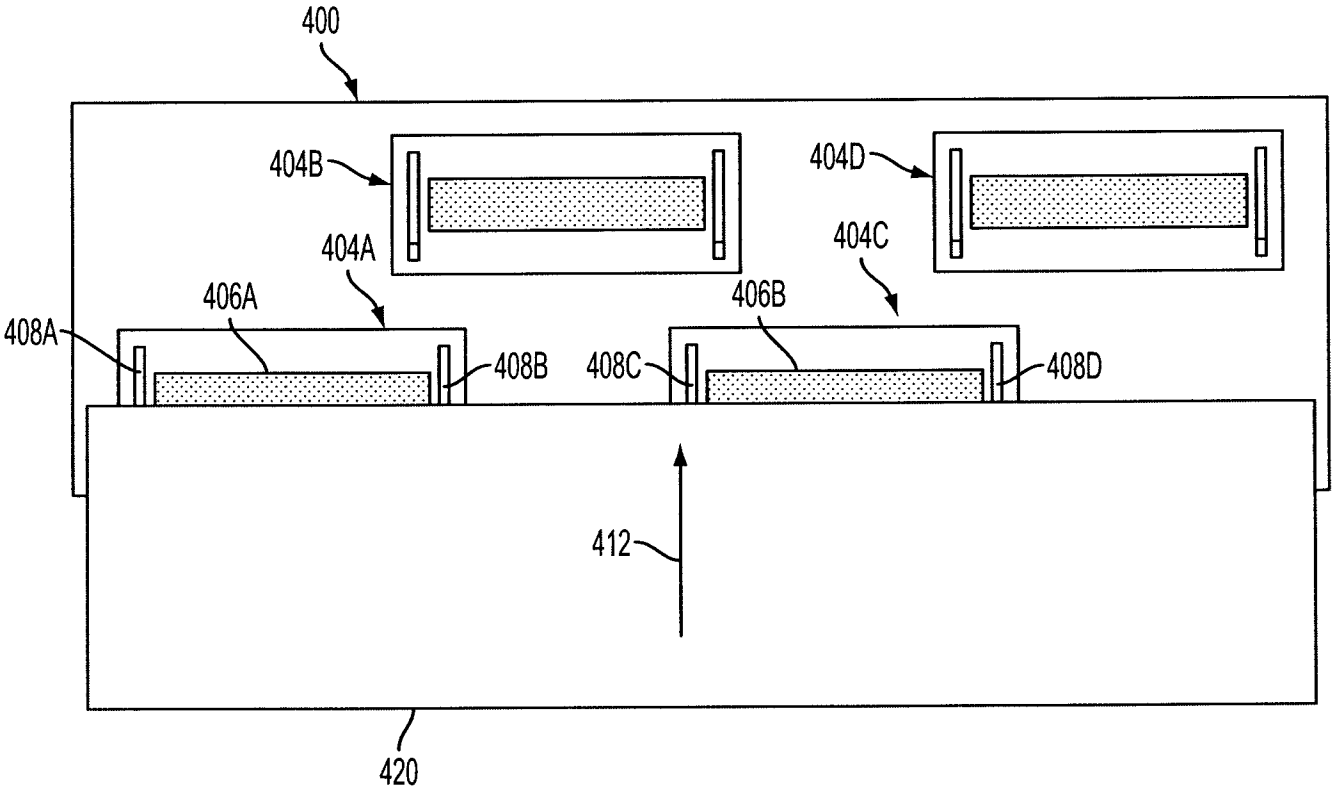
FIG. 4A is a frontal view of the inkjet printhead array of FIG. 2 with a leading edge of a print medium passing over the inkjet printhead array.

A printhead array having a leading edge of a print medium moving over the printhead array is depicted in FIG. 4A. In FIG. 4A, print medium 420 travels over the printhead array 400 in the direction indicated by arrow 412. While traveling over printheads 404A and 404C, the print medium 420 passes over nozzle protector members 408A and 408B on printhead 404A, and 408C and 408D on printhead 404C. If the print medium 420 is curled or otherwise distorted, the nozzle protector members maintain separation between the print medium 420, and the nozzles in the aperture plates 406A and 406B.

Figure 4B:
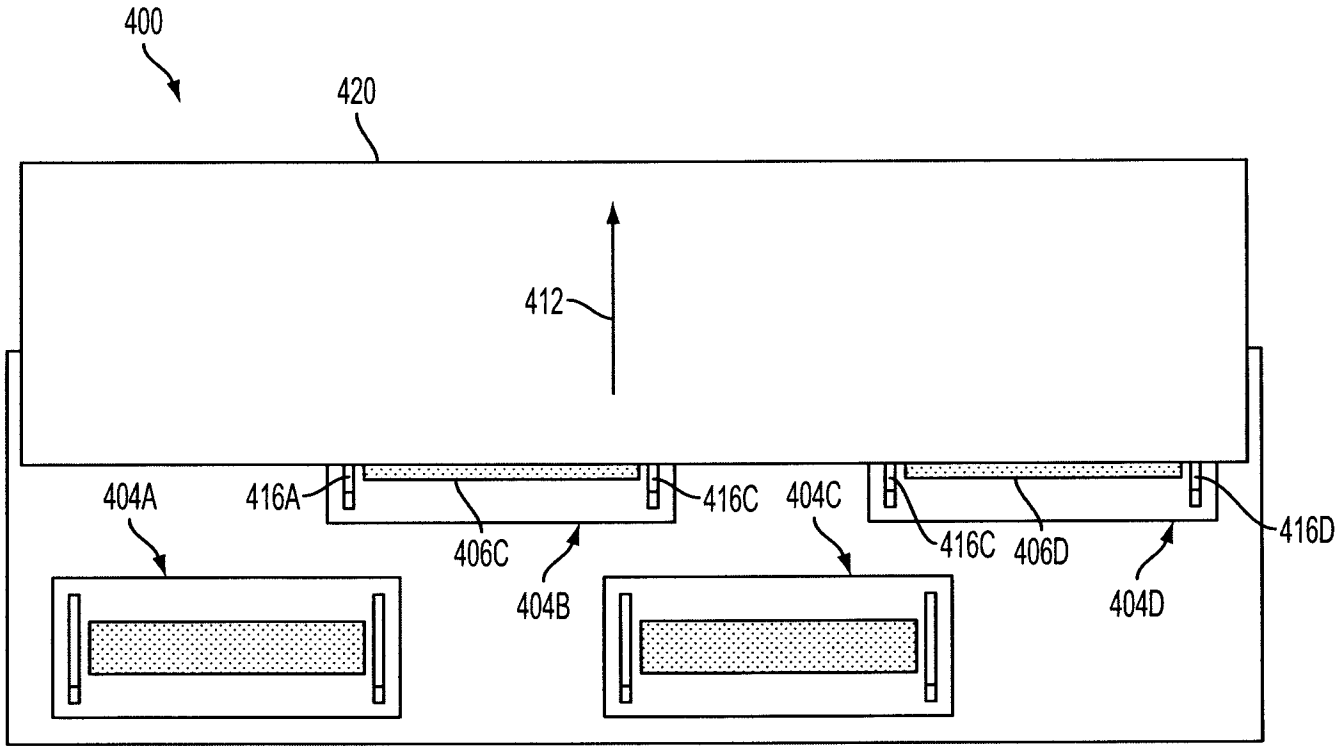
FIG. 4B is a frontal view of the inkjet printhead array of FIG. 2 with a trailing edge of a print medium passing over the inkjet printhead array.

A printhead array having a trailing edge of a print medium moving over the printhead array is depicted in FIG. 4B. As in FIG. 4A, the print medium 420 moves over printhead array 400 in the direction indicated by arrow 412. In FIG. 4B, the print medium 420 is moving over the printheads 404B and 404D. Printhead 404B has nozzle protector members 416A and 416B, and printhead 404D has nozzle protector members 416C and 416D. If the print medium 420 is curled or distorted, the nozzle protector members 416A-416D block the print medium 420 from contacting the nozzles in the surfaces of the aperture plates 406C and 406D.

Figure 5A:
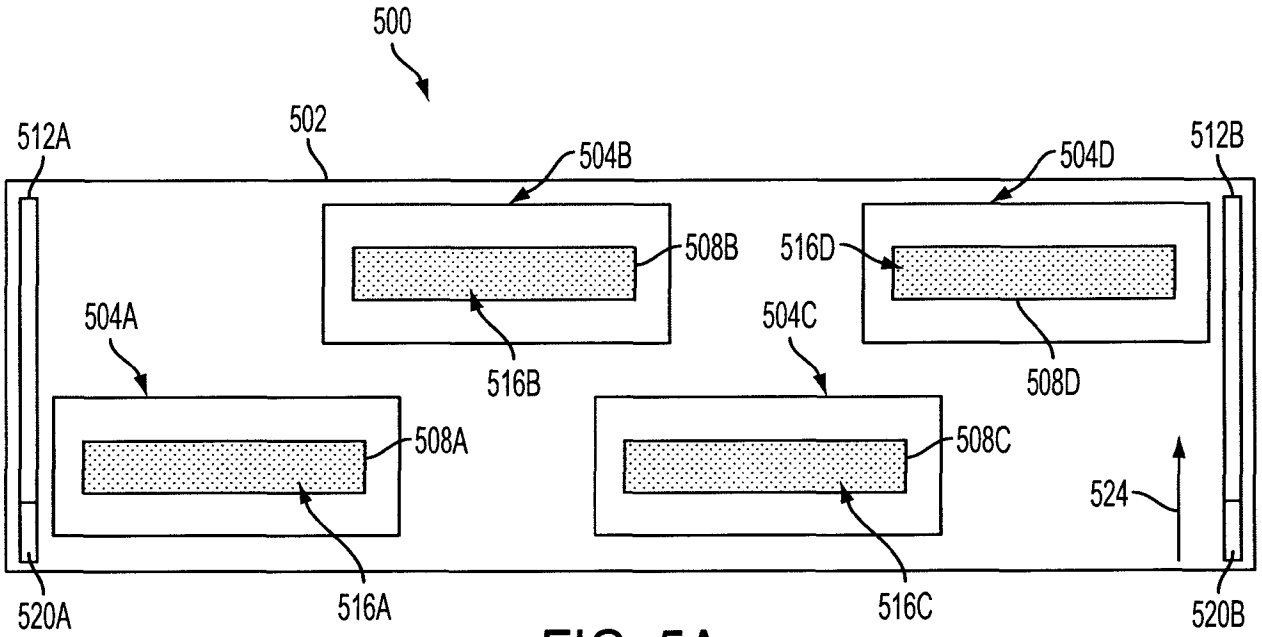
FIG. 5A is a frontal view of an alternative inkjet printhead array having a plurality of inkjet printheads and a nozzle protector.

An alternative embodiment of a printhead array with a nozzle protector is depicted in FIG. 5A. In this embodiment, printhead array 500 has printheads 504A-504D placed in a staggered arrangement similar to that of FIG. 2. Printheads 504A-504D have aperture plates 508A-508D, respectively. Each aperture plate has a plurality of apertures 516A-516D, or nozzles, that eject ink from the printhead. The printhead array 500 has a housing 502 containing the printheads 504A-504D and a nozzle protector including a pair of raised members 512A and 512B. These nozzle protector members are aligned with the direction of movement of a print medium passing over the printhead array 500, indicated by arrow 524. The nozzle protector members 512A and 512B each extend along the combined lengths of all the printheads 504A-504D in the printhead array 500. As with the nozzle protector members shown in FIG. 1A and FIG. 1B, nozzle protector members 512A and 512B each include a ramp, 520A and 520B, which extends away from the printhead array 500. The ramps 520A and 520B are placed in the print media path such that the leading-edge of a print medium traveling in direction 524 engages the ramps 520A and 520B before the print medium begins to move over the exposed aperture plate 508.

Figure 5B:
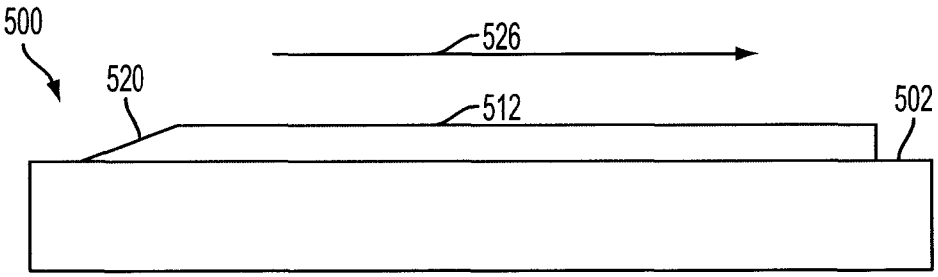
FIG. 5B is a side view of the printhead array of FIG. 5A.

FIG. 5B depicts a side view of the printhead array 500 of FIG. 5A. The printhead array 500 has housing 502 supporting nozzle protector member 512. The nozzle protector member 512 has a ramp 520 that extends from the housing 502 to the top of nozzle protector member 512, at a predetermined distance from the housing 502. The ramp 520 is aligned with the direction of movement of a print medium, indicated by arrow 526.

While the nozzle protector members 512A and 512B shown in FIG. 5A and FIG. 5B have a similar shape to those depicted in FIG. 1A and FIG. 1B, the dimensions chosen for nozzle protector members 512A and 512B may differ. For example, nozzle protectors 512A and 512B have longer lengths and wider widths in order to accommodate the size of the entire printhead array. Additionally, the predetermined distance that the nozzle members 512A and 512B extend from the printhead array housing 502 may be a different distance than for nozzle protector members used with a single printhead.

Figure 6A:
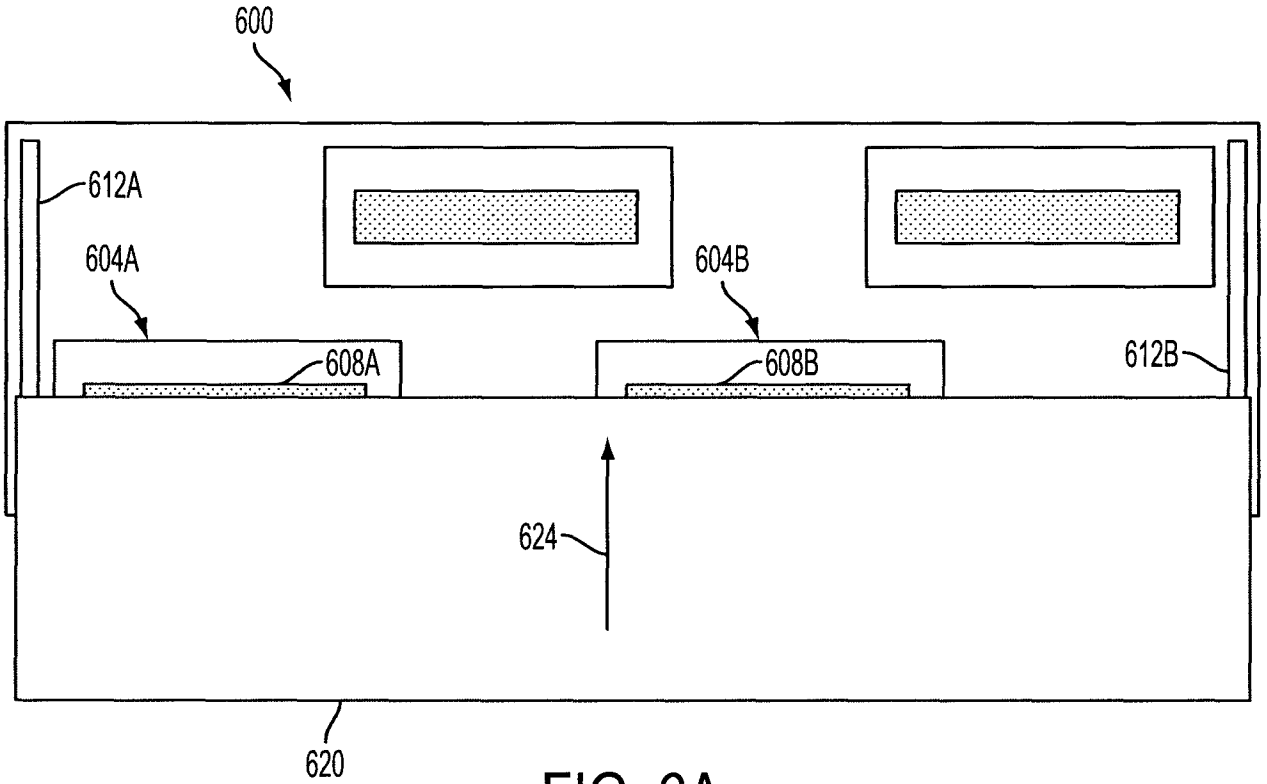
FIG. 6A is a frontal view of the inkjet printhead array of FIG. 5 with a leading edge of a print medium passing over the inkjet printhead array.
Figure 6B:
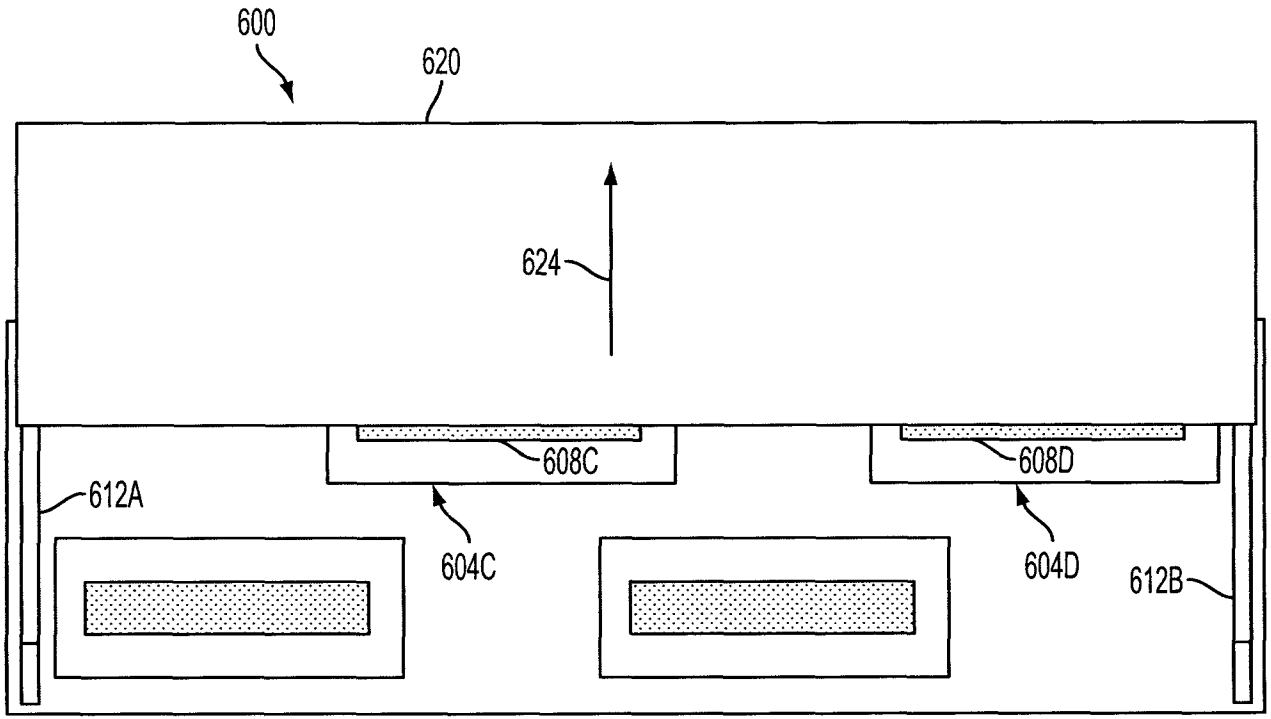
FIG. 6B is a frontal view of the inkjet printhead array of FIG. 5 with a trailing edge of a print medium passing over the inkjet printhead array.

A print medium moving over the printhead array of FIG. 5A is depicted in FIG. 6A and FIG. 6B. Print medium 620 moves over the printhead array 600 in the direction indicated by arrow 624. FIG. 6A depicts the leading edge of print medium 624 passing over printheads 604A and 604B. If the print medium 624 is curled or distorted, the nozzle protection members 612A and 612B block the print medium 624 from contacting the nozzles in aperture plates 608A and 608B. The print medium moves over the printhead array 600 with a trailing edge shown in FIG. 6B. If the trailing edge is curled or distorted, the nozzle protections members 612A and 612B extend along the length of printheads 604C and 604D, and block the print medium 624 from contacting the nozzles in aperture plates 608C and 608D.

Although many of the figures discussed above show the printheads in an upward facing direction for ease of illustration, the reader should appreciate that most printing systems orient printheads in a downwardly facing or horizontally facing configuration and that the protective structure described herein may be applied to all such configurations. If the printhead faces downwardly, then the media is moved by the protective structure downwardly away from the printhead. If the printhead is oriented to eject ink horizontally, then the media is moved by the protective structure in a generally horizontal direction away from the printhead. Additionally, if a printhead faces upwardly, the media is lifted in upwardly away from the printhead.

Those of ordinary skill in the art will recognize that numerous modifications may be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An inkjet printhead comprising:

a housing;

an aperture plate having a plurality of apertures in an aperture area through which inkjet ejectors eject ink onto media as the media moves past the printheads in a first direction; and a pair of members extending from a surface of the housing, each member extending along a length of the aperture area and being on a side of the aperture area opposite another side of the aperture area along which the other member extends, each member having a first end, a second end and a length between the first end and the second end that is aligned with the first direction, and each member in the pair of members having a ramp at the first end of the member that slopes from the surface of the housing to a surface of the member that is vertically displaced from the surface of the housing and the ramp extends along a portion, but not all, of the length of the member to enable the ramp to engage a leading edge of media moving in the first direction to be lifted by the ramp to the vertically displaced surface of the member before the leading edge reaches the plurality of apertures.

2. The inkjet printhead of claim 1, each member in the pair of members extending beyond a length of the aperture area and the second end of each member being perpendicular to the surface of the housing.

3. The inkjet printhead of claim 1, each surface of each member vertically displaced from the surface of the housing being vertically displaced by a predetermined distance above the aperture plate along the length of each member between the ramp and the second end.

4. The inkjet printhead of claim 1, further comprising:

a layer of adhesive underneath each member to mount each member to the housing.

5. An inkjet printhead array comprising:

a plurality of printheads arranged in an array of printheads to eject ink in a continuous line across media as the media passes by the plurality of printheads in a first direction that is perpendicular to the continuous line, each printhead having an aperture plate having a plurality of apertures through which inkjet ejectors eject ink; and only one pair of members positioned proximate the plurality of printheads, each member in the pair of members being positioned so no member is located within the array of printheads and each member extends along a side of the array of printheads that is opposite another side of the array along which the other member in the pair of members extends, each member in the pair of members having a first end, a second end, and a length between the first end and the second end that is aligned with the first direction, and each member having a ramp at the first end of the member that slopes from a surface in a common plane with the aperture plates in the printhead array to a surface of the member that is vertically displaced from the surface of the common plane, the ramp extending along a portion, but not all, of the length of the member to enable the ramp to engage a leading edge of media moving in the first direction to be lifted by the ramp to the vertically displaced surface of the member before the leading edge reaches the plurality of apertures.

6. The inkjet printhead array of claim 5, the pair of members extending beyond a length of the sides of the printhead array that extends in the first direction past the plurality of printheads.

7. The inkjet printhead array of claim 5, each surface of each member vertically displaced from the surface of the common plane being vertically displaced by a predetermined distance above the aperture plate along the length of each member between the ramp and the second end.

8. The inkjet printhead array of claim 5 further comprising:

a layer of adhesive underneath each member in the pair of members to mount each member proximate the plurality of printheads.

9. An inkjet printhead array comprising:

a plurality of printheads arranged to eject ink in a continuous line across media passing by the plurality of printheads, each printhead in the plurality of printheads including:

a housing;

an aperture plate having a plurality of apertures in an aperture area through which inkjet ejectors eject ink onto media moving past the inkjet ejectors in a first direction; and a pair of members extending from a surface of the housing for each printhead, each member extending along a length of the aperture area on a side of the aperture area that is opposite another side of the aperture along which the other member extends, each member having a first end, a second end, and a length between the first end and the second end that is aligned with the first direction, and each member in the pair of members having a ramp at the first end of the member that slopes from the surface of the housing to a surface of the member that is vertically displaced from the surface of the housing and the ramp extends along a portion, but not all, of the length of the member to enable the ramp to engage a leading edge of media moving in the first direction to be lifted by the ramp to the vertically displaced surface of the member before the leading edge reaches the plurality of apertures.

10. The inkjet printhead of claim 9, each member in the pair of members extending beyond a length of the aperture area in the first direction and the second end of each member being perpendicular to the surface of the housing.

11. The inkjet printhead of claim 9, each surface of each member vertically displaced from the surface of the housing being vertically displaced by a predetermined distance above the aperture area along the length of each member between the ramp and the second end.

12. The inkjet printhead of claim 9, further comprising:

a layer of adhesive underneath each member to mount each member to the housing.

* * * * *